US009995075B2

(12) United States Patent
Vanini

(10) Patent No.: US 9,995,075 B2
(45) Date of Patent: Jun. 12, 2018

(54) DAMPENED HINGE

(71) Applicant: NUOVA STAR S.p.A., Zola Predosa (Bologna) (IT)

(72) Inventor: Marco Vanini, Bologna (IT)

(73) Assignee: Nuova Star S.p.A., Zola Predosa (Bologna) (IT)

( * ) Notice: Subject to any disclaimer, the term of this patent is extended or adjusted under 35 U.S.C. 154(b) by 0 days. days.

(21) Appl. No.: 15/696,652

(22) Filed: Sep. 6, 2017

(65) Prior Publication Data

US 2018/0073291 A1 Mar. 15, 2018

(30) Foreign Application Priority Data

Sep. 9, 2016 (IT) ..... 102016000091383

(51) Int. Cl.
*E05F 1/08* (2006.01)
*E05F 3/20* (2006.01)
(Continued)

(52) U.S. Cl.
CPC ..... *E05F 3/20* (2013.01); *E05D 3/18* (2013.01); *E05F 3/02* (2013.01); *E05F 3/10* (2013.01); *E05Y 2900/30* (2013.01)

(58) Field of Classification Search
CPC ... F16F 15/03; F16F 6/00; F16F 6/005; F24C 15/02; F24C 15/023; E05F 1/1276; E05F 1/1292; E05F 1/1261; E05F 1/1253; E05F 3/02; E05F 3/10; E05Y 2201/41; E05Y 2201/412; E05Y 2201/414; E05Y 2201/416; E05Y 2201/40; E05Y 2201/46;
(Continued)

(56) References Cited

U.S. PATENT DOCUMENTS 6,397,836 B1 6/2002 Pelletier et al.
2003/0056328 A1* 3/2003 Habegger ..... E05F 1/1276 16/343
(Continued)

FOREIGN PATENT DOCUMENTS

EP 2977537 A1 1/2016

OTHER PUBLICATIONS

Italian Search Report dated May 11, 2017 from counterpart Italian App No. IT 201600091383.

*Primary Examiner* — Chuck Mah
(74) *Attorney, Agent, or Firm* — Shuttleworth & Ingersoll, PLC; Timothy Klima

(57) ABSTRACT

A hinge for doors of appliances, including a box-shaped element and a first lever pivoted on the box-shaped element by a first pin; one of the box-shaped element or the first lever being fixable to a frame and the other fixable to a door, to make the door tiltably movable relative to the frame between a closed position and an open position; a first elastic device supported by the box-shaped element for applying an elastic action on the first lever, a rod for connecting the first lever to the first elastic device, the connecting rod being positioned in a slidable fashion inside the box-shaped element; a damping member for applying a damping action during the reciprocal motion of the first lever and the box-shaped element, in the proximity of reaching the closed position; a cartridge containing the hydraulic damping member, the cartridge being fixed to the box-shaped element.

20 Claims, 6 Drawing Sheets

(51) Int. Cl.
*E05D 3/18* (2006.01)
*E05F 3/02* (2006.01)
*E05F 3/10* (2006.01)

(58) Field of Classification Search
CPC ..... E05Y 2900/30; E05Y 2900/308; E05D 11/1064; E05D 3/18; Y10T 16/5383
See application file for complete search history.

(56) References Cited

U.S. PATENT DOCUMENTS

2007/0283532 A1* 12/2007 Vanini ..... E05F 1/1261 16/277
2008/0092333 A1* 4/2008 Migli ..... E05F 5/006 16/221
2008/0098565 A1* 5/2008 Migli ..... E05F 5/006 16/239
2008/0201907 A1* 8/2008 Vanini ..... E05F 1/1261 16/342
2008/0289144 A1* 11/2008 Vanini ..... E05F 1/1261 16/221
2009/0165244 A1* 7/2009 Pyo ..... E05F 5/006 16/250
2010/0101052 A1* 4/2010 Waltemate ..... E05D 3/16 16/297
2010/0148646 A1* 6/2010 Bettinzoli ..... E05F 1/1261 312/326
2010/0212112 A1* 8/2010 Steurer ..... E05F 1/1261 16/286
2010/0281650 A1* 11/2010 Kleemann ..... A47L 15/4261 16/64
2011/0072617 A1* 3/2011 Lin ..... E05F 5/006 16/298
2011/0146655 A1* 6/2011 Basavalingappa Mudbasal ..... E05F 1/1261 126/194
2012/0067333 A1* 3/2012 Mirshekari ..... E05F 1/1041 126/192
2012/0180261 A1* 7/2012 Zimmer ..... E05F 5/006 16/319
2014/0130302 A1* 5/2014 Bettinzoli ..... E05F 1/1261 16/304
2016/0153224 A1* 6/2016 Salice ..... E05D 3/16 16/52
2016/0273777 A1* 9/2016 Kim ..... F24C 15/023
2016/0348919 A1* 12/2016 Ivanovic ..... E05F 1/1261

* cited by examiner

DAMPENED HINGE

This application claims priority to Italian Patent Application 102016000091383 filed Sep. 9, 2016, the entirety of which is incorporated by reference herein.

BACKGROUND OF THE INVENTION

This invention relates to a hinge for doors of domestic appliances.

More specifically, this invention relates to a hinge for electric household appliances equipped with an internal damper.

SUMMARY OF THE INVENTION

This specification describes the hinge according to the invention with reference to an oven purely by way of example and without restricting the scope of the inventive concept.

In the ovens of known type, the hinges used normally comprise a box-shaped structure connected by a kinematic mechanism to a lever, with the lever and the box-shaped structure designed to open mutually in a tilting fashion.

The box-shaped structure and the lever are designed so as to be connected one to a door and the other to a frame of the oven.

More in detail, one between the box-shaped structure and the lever is fixed to the frame of the oven, at a side of the access opening of the latter, whilst the other is fixed to an edge of the door, which in this way is made tiltably movable relative to the above-mentioned frame.

Elastic elements act on the above-mentioned lever which influence the movement of the door during both opening and closing.

When the oven door is tilted away from the closed position, the elastic elements oppose, firstly, the movement which detaches the door from the oven mounting frame and, secondly, the subsequent rotational movement of the door and its consequent lowering to the position in which the access opening of the oven is fully open. During the second part of its opening movement, the door, under the combined action of its weight, which tends to pull it downwards, and of the elastic elements, which oppose this downward pulling action, is thus made to turn gradually.

When the oven door is tilted up from the fully open limit position, the action of the elastic elements is first balanced by the weight of the door, thus initially ensuring that it turns gradually towards the closed position. After that, however, if the user is not careful to slow the door down, the force of the elastic elements tends to push it forcefully towards the oven frame, causing it to slam shut, often rather suddenly and noisily.

For this purpose, that is to say, for applying an braking action, suitable damping means have been introduced in the hinges.

The use of internal dampers in hinges in order to slow the closing or opening of the door is well known in the prior art.

The introduction of these damper elements in the hinges for electric household appliances has given rise to numerous problems.

A first drawback is due to the difficulty of inserting damping members in the limited space available for housing the hinges which are actually effective and long-lasting.

It is clear that the damping capacity of a damping member must take into consideration its actual dimensions.

Another problem linked with the introduction of damping members inside the hinges consists in the difficulty of associating the damping action of the damping member with the movement of the hinge.

In other words, since the stroke of the damping member, which normally consists of a cylinder and a piston slidable lengthways, has a predetermined amplitude and has its maximum effectiveness in a stretch of the stroke, it is often complicated to harmonize the amplitude with the angular stretch of the movement in which a damping action is actually requested.

In effect, a damping action which is exerted outside the required interval, for example near to the closing of the oven door, would constitute an obstacle for the closing of the oven, forcing the manufacturer to increase the size of the elastic elements.

The prior art dampened hinges often have quite articulated actuation mechanisms and comprise a plurality of dynamically connected elements; the clearances naturally existing between these elements cause imprecisions in the actuation of the damping member and this circumstance easily leads to irregularities in the operation of the hinge and, more generally speaking, the electrical household appliance as a whole.

Moreover, even though existing solutions of dampened hinges sometimes demonstrate themselves to be sufficiently efficient from the functional point of view they are at the same time relatively complex when assembling.

The aim of this invention is to provide a dampened hinge for doors of domestic appliances which is free of the above-mentioned drawbacks and is, at the same time, structurally simple and practical and effective to use.

A further aim of this invention is to provide a dampened hinge for electric household appliances wherein the actuation of the damping member is performed directly and through a limited number of mechanical parts.

The technical characteristics of the invention according to the aforementioned aim may be easily inferred from the present disclosure.

BRIEF DESCRIPTION OF THE DRAWINGS

The advantages of the invention are more apparent from the detailed description which follows, with reference to the accompanying drawings which illustrate a preferred, non-limiting example embodiment of the invention and in which.

DESCRIPTION OF THE PREFERRED EMBODIMENTS

Figure 1:
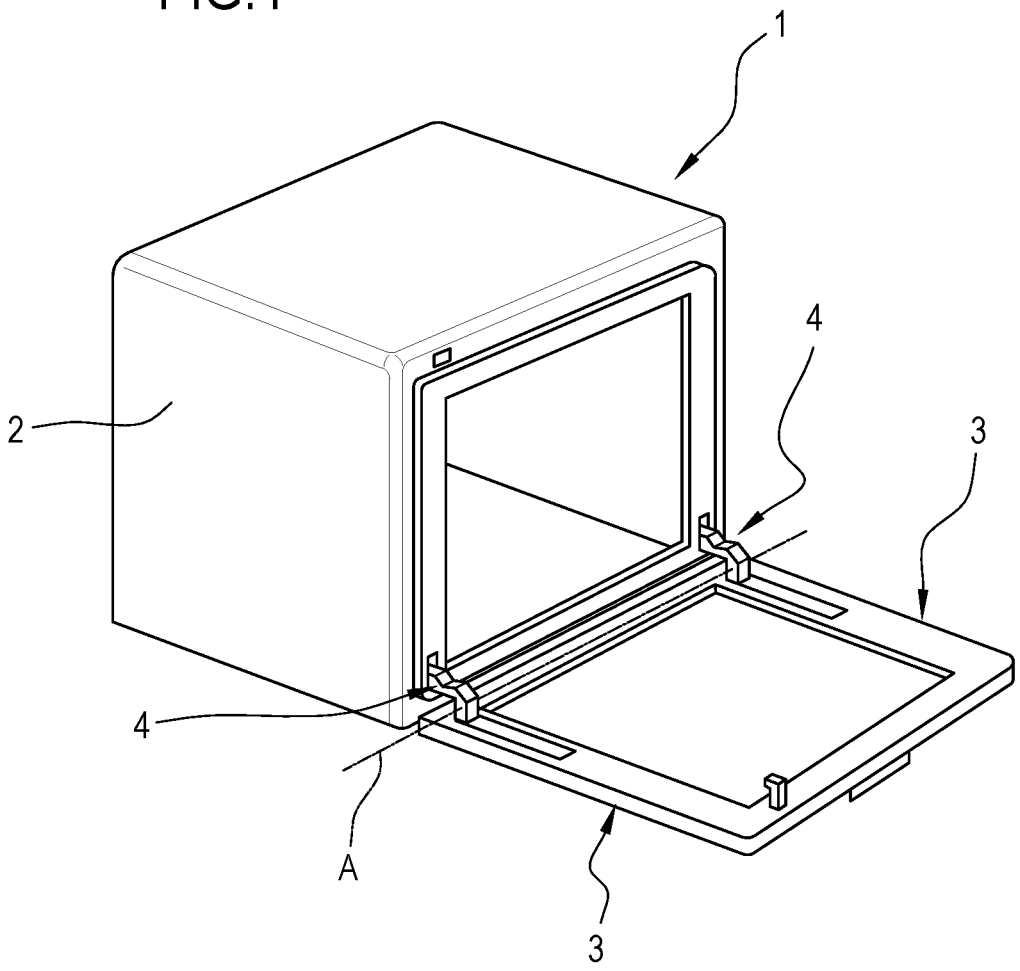
FIG. 1 is a schematic perspective view from above of an oven with a door connected to it by two hinges made in accordance with the present invention.

The numeral 1 in FIG. 1 denotes in its entirety an oven comprising a frame 2 to which a door 3 is connected by two hinges 4 which enable it to be tiltably rotated about a horizontal axis A.

FIGS. 2 to 5 show preferred embodiments of a hinge 4 made according to this invention.

Each of the two hinges 4 comprises a first lever 5, fixed to the frame 2 of the oven 1 at a respective side of the access opening of the latter, and an box-shaped element 6, fixed to a respective edge of the door 3.

The first lever 5 is fixed to the frame 2 either directly or by interposing a respective box-shaped body not illustrated.

The box-shaped element 6 has an elongate shape and extends lengthways along a predetermined axis X.

Advantageously, the box-shaped element 6 has, except for certain stretches, a C-shaped transversal cross section.

Figure 2:
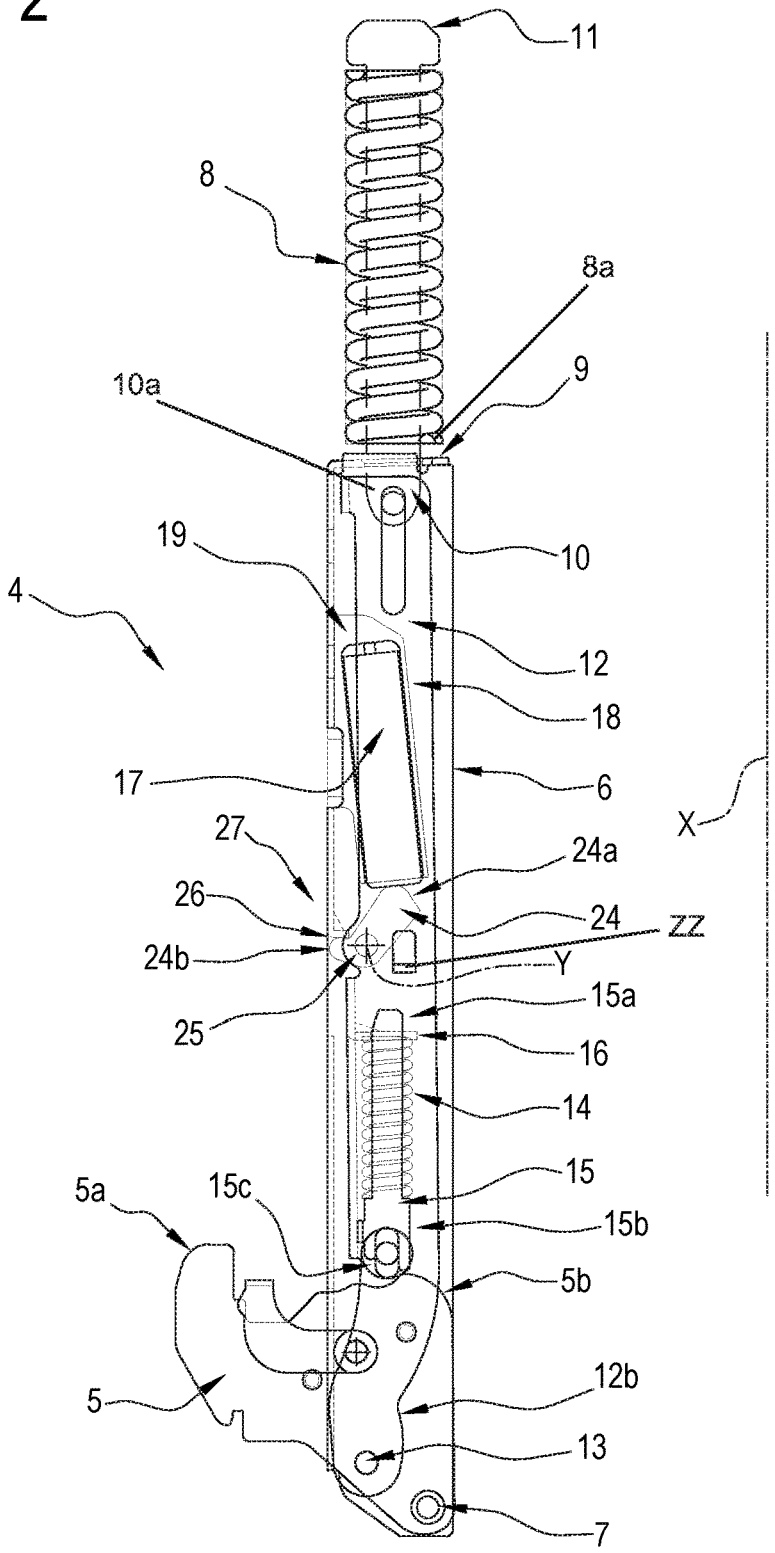
FIG. 2 is a schematic side elevation view, with some parts in cross-section and others transparent, to better illustrate others, of a preferred embodiment of the hinge according to this invention.
Figures 3, 4, 5:
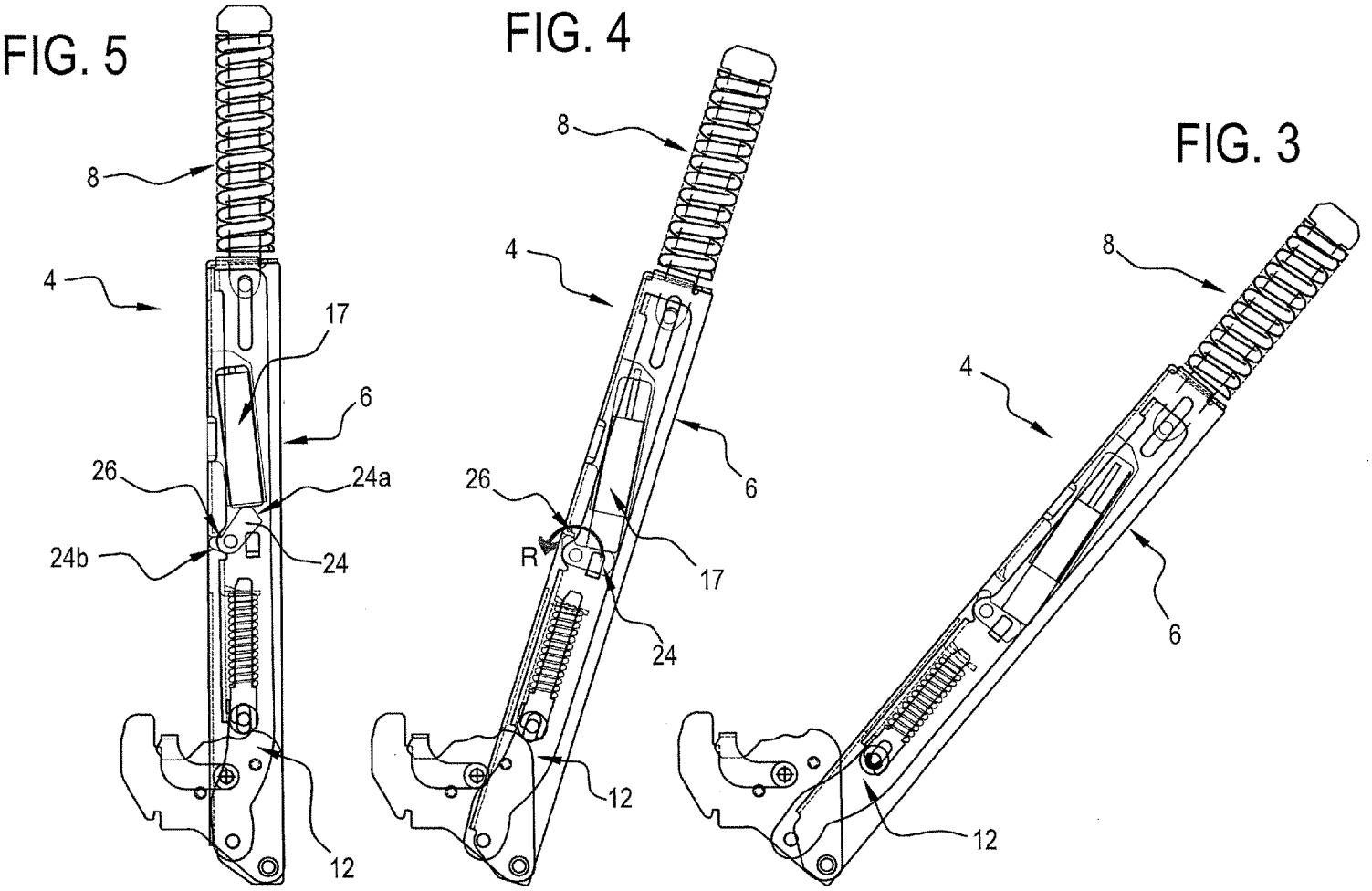
FIGS. 3 to 5 are respective schematic side elevation views of the hinge of FIG. 2 in a sequence of three successive different configurations of use.

The first lever 5 is pivoted on the box-shaped element 6 by means of a pin 7 and has a portion 5*a* constrained rigidly to the frame 2 to make the door 3 tiltably movable relative to the frame 2, between a closed end position, illustrated in FIGS. 2 and 5, and an open end position, illustrated in FIG. 1.

As illustrated in FIGS. 2 to 5, the hinge 4 comprises a first helical spring 8 housed outside the box-shaped element 6.

The first spring 8 designed to abut, with a relative lower end turn 8*a*, with a transversal end wall 9 of the box-shaped element 6.

The first spring 8 is kept in abutment against the above-mentioned transversal wall 9 by the head 11 of a compression rod 10 which is positioned coaxially inside the first spring 8 and which defines a guide for the first spring 8.

The first spring 8 defines, for the hinge 4, first elastic means designed to apply an elastic action on the first lever 5.

The compression rod 10 protrudes below from the first spring 8 with an end 10*a*, which passes through an opening made in the transversal wall 9 to couple, by means of a connecting element (not illustrated), to an upper end 12*a* of a connecting rod 12, acting as tie rod.

The connecting rod 12 has lower end 12*b* hinged to the first lever 5 by a pin 13 located near the above-mentioned pin 7.

The connecting rod 12 also has an elongate shape and extends lengthways along the above-mentioned predetermined direction X.

As illustrated in the drawings, the connecting rod 12 is substantially box-shaped, meaning that its side walls 12L delimit a respective inner space.

The connecting rod 12 is slidably housed inside the box-shaped element 6.

The connecting rod 12 is advantageously made of sheet metal.

The position of the pin 13, at which the elastic reaction force of the first spring 8 is applied, relative to the pin 7, and the pre-compression of the first spring 8, guarantee an elastic action which tends to push the door 3 into its closed position.

With reference to the accompanying FIGS. 2 to 5, the hinge 4 comprises a second helical spring 14 fitted on a respective rod 15.

The second helical spring 14 and the related rod 15 are supported by the connecting rod 12.

The rod 15 has an upper first end 15*a* inserted slidably in a suitable guide 16 integral with a wall of the connecting rod 12.

Advantageously, the guide 16 is made on a folded metal sheet flap constituting the above-mentioned wall of the connecting rod 12.

The rod 15 has a second lower end 15*b* supporting a roller 15*c*.

The roller 15*c* is designed to engage with a respective cam-shaped portion 5*b* of the first lever 5 for defining with it a cam-follower coupling.

The second helical spring 14, together with the respective rod 15 defines means for closing the hinge 4, that is to say, elastic means designed to guarantee the closed position of the door 3 of the oven as well as second elastic means designed to apply an elastic action on the first lever 5.

The hinge 1 comprises a hydraulic damping member 17 for applying a damping action during the reciprocal motion between the first lever 5 and the box-shaped element 6, in the proximity of reaching their above-mentioned mutual closed position.

The term hydraulic damping member is used to mean, in this description, any gas or fluid damping member, of substantially known type, wherein the gas or fluid slides from one chamber to another following the mutual movement of its two parts.

The hinge 1 comprises a cartridge 18 for containing the hydraulic damping member 17.

The cartridge 18 is removable, meaning that it is inserted already assembled inside the box-shaped element 6 during assembly of the hinge 1.

The cartridge 18 is located stably inside the box-shaped element 6.

Figure 6:
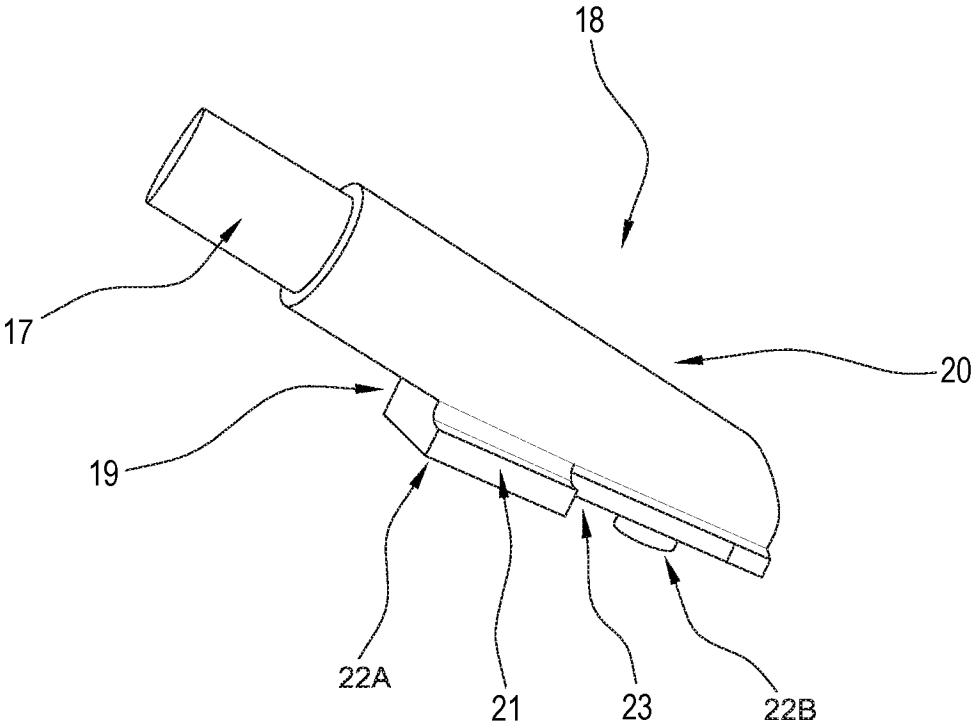
FIGS. 6 and 7 are schematic perspective views showing different details of the hinge of the preceding figures.

With reference to FIG. 6, the cartridge 18 advantageously comprises a base 19 and a central body 20 for housing the damping member 17.

The main body 20 engages in an inclined fashion on the base 19.

The base 19 has, on both sides, two snap-on fastening elements 21 designed to be inserted in suitable housings made on the side walls of the box-shaped element 6.

The base 19 has, at its bottom wall, protruding portions 22A and 22B designed to be inserted in suitable cavities shaped to match formed in the central wall of the box-shaped element 6 to form respective shape impediments preventing the sliding of the cartridge 18 with respect to the box-shaped element 6.

Advantageously, the base 19 has two lateral fins 23.

The fins 23 contribute to the centering of the cartridge 18 inside the box-shaped body 6.

Figure 8:
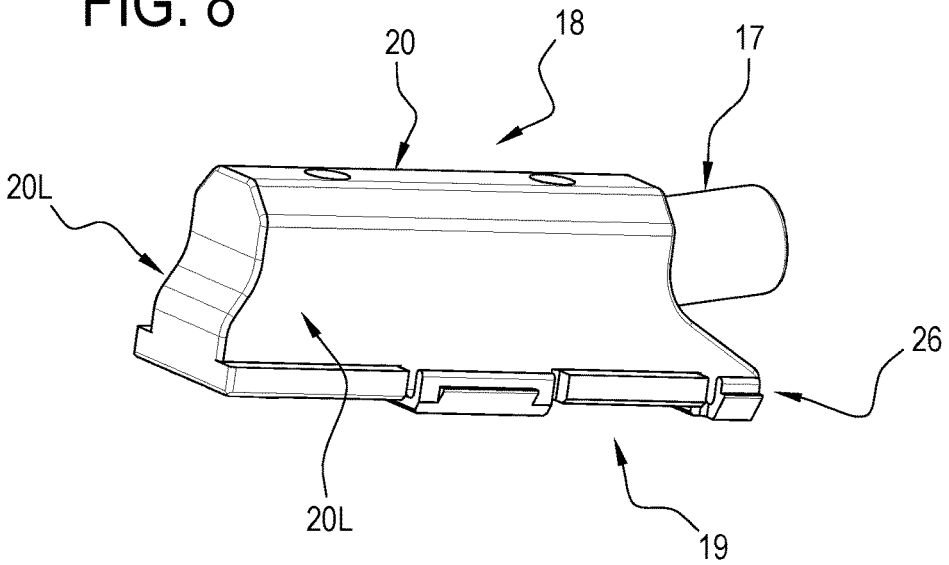
FIG. 8 is a schematic perspective view a variant embodiment of the detail of FIG. 6.

With reference in particular in the embodiment illustrated in FIG. 8, the central body 20 of the cartridge 18 has two side surfaces 20L, substantially flat and designed to face respective inner faces of the 12L side walls of the connecting rod 12.

Advantageously, by suitably sizing with limited clearances, a friction action is actuated during the sliding between the connecting rod 12 and the above-mentioned side 20L surfaces of the body 20 which is a useful for improving the general operation of the hinge, in particular in terms of balancing and slowing down.

Moreover, the presence of the above-mentioned central body 20 also advantageously allows a centering of the connecting rod 12 relative to the box-shaped casing 6, thereby limiting the risk of contact and sliding between the two components during their relative movement during the operation of the hinge 1.

The base 19 is advantageously made of plastic material and the selection of the type of material is also made in consideration of the surface smoothness characteristics, that is to say, the friction coefficient.

Preferably, therefore, the base 19 (at least when the above-mentioned friction is not requested) is made of plastic material with a low friction coefficient.

Figure 7:
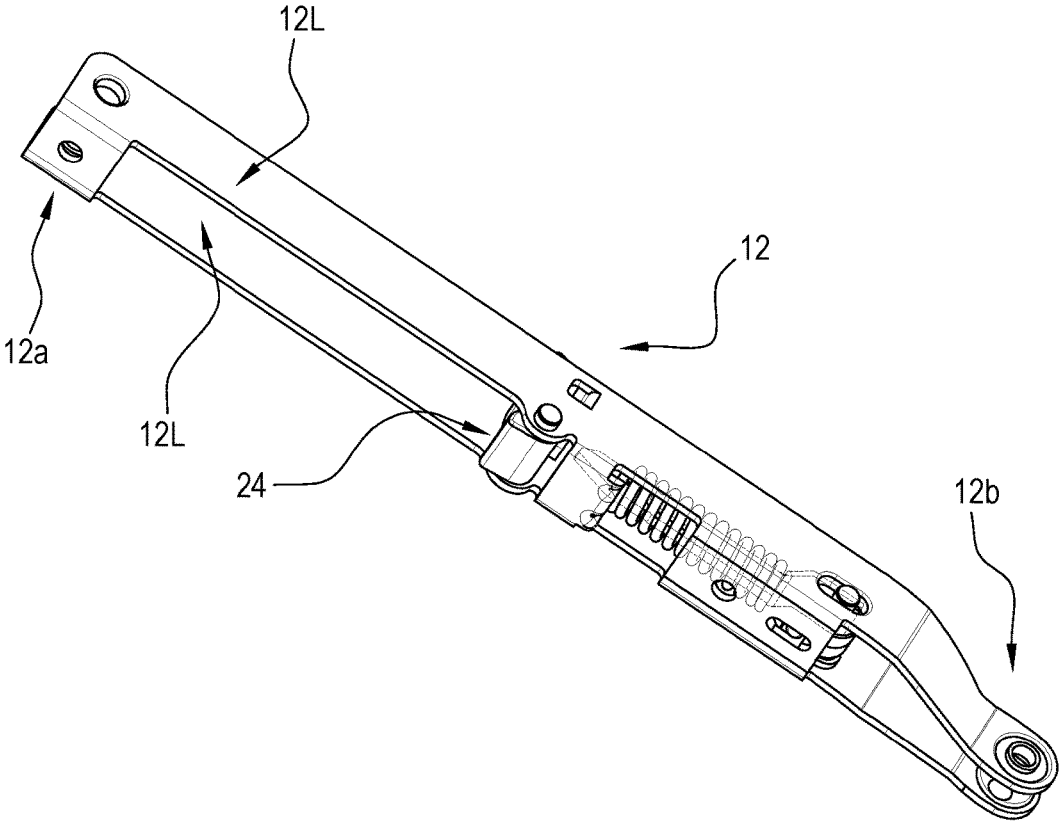

As illustrated in FIG. 7, the connecting rod 12 supports a rocker lever 24 acting on the damping member 17.

The rocker lever 24 is pivoted on a respective pin 25 fixed to the side walls 12L facing each other of the connecting rod 12 in a box-shaped fashion.

A rocker lever 24 is designed to oscillate about a respective pivot axis Y, perpendicular to the plane of the drawings.

The rocker lever 24 has, on opposite sides of the pivot axis Y, a first arm 24*a* and a second arm 24*b*.

The first arm 24*a* is designed to engage with the above-mentioned damper cylinder 17.

The second arm 24*b* is designed to engage in contact with a respective contact portion 26 fixed relative to the box-shaped element 6.

In the embodiment illustrated in FIGS. 2 to 5, the above-mentioned contact portion 26 is formed on the box-shaped element 6.

Advantageously, the above-mentioned contact portion 26 is defined by a tooth made by folding a flap of the central wall of the box-shaped element 6, the tooth facing the space inside the box-shaped element 6.

According to the variant embodiment, illustrated in FIG. 8 (and also in FIG. 9 in an assembled configuration), the above-mentioned portion 26 is advantageously defined by the base 19 of the cartridge 18, the base 19 thus projecting in a cantilever fashion relative to the central body 20 of the cartridge 18.

The embodiment just described offers the advantage of an excellent precision of contact between the contact portion 26 and the rocker lever 24, since the molding of the plastic material allows a high precision in the sizing of the parts. This solution is also very robust (relative to the tooth in the metal sheet which could bend with significant impacts) and easily industrialized (box-shaped element 6 more simple to construct).

The above-mentioned rocker lever 24 and contact portion 26 define, for the hinge 4, respective means 27 for actuating the damper cylinder 17.

The operation of the hinge 4 is briefly described below.

Starting from a position of partial opening of the door 3, for which the corresponding configuration of the hinge 4 is illustrated in FIG. 3, a rotation of the door 3 towards the closed position is favored by the action of the helical spring 8 and is initially obstructed by the weight of the door 3.

In the configuration of the hinge 4 illustrated in FIG. 3 the damping member 17 is not yet activated.

FIG. 4 shows the hinge 4 in a further intermediate closing position of the door 3, at which the cam-shaped portion 5*b* of the first lever 5 comes into contact with the roller 15*c* of the rod 15 for compressing the second helical spring 14.

In the configuration just described, as a result of relative sliding between the connecting rod 12 and the box-shaped element 6, a contact is established between the second the arm 24*b* of the lever 24 and the tooth defined by the above-mentioned contact portion 26.

More in detail, before the rocker lever 24 engages with the contact portion 26 and begins to rotate, accelerating the compression the damping member 17, there can be a step in which the rocker lever 24 is integral with the connecting rod 12 and rests on a contact element ZZ; due to the effect of the rotation of the door 3, the connecting rod 12 moves, moving also the rocker lever 24, which with its arm 24*a* starts to slowly compress the damping member 17. This first step, if adopted, has the advantage of reducing the "rebound" effect of the door 3 which there would be by immediately accelerating the damping member 17, that is to say, by applying to it a quite vigorous action.

Figure 9:
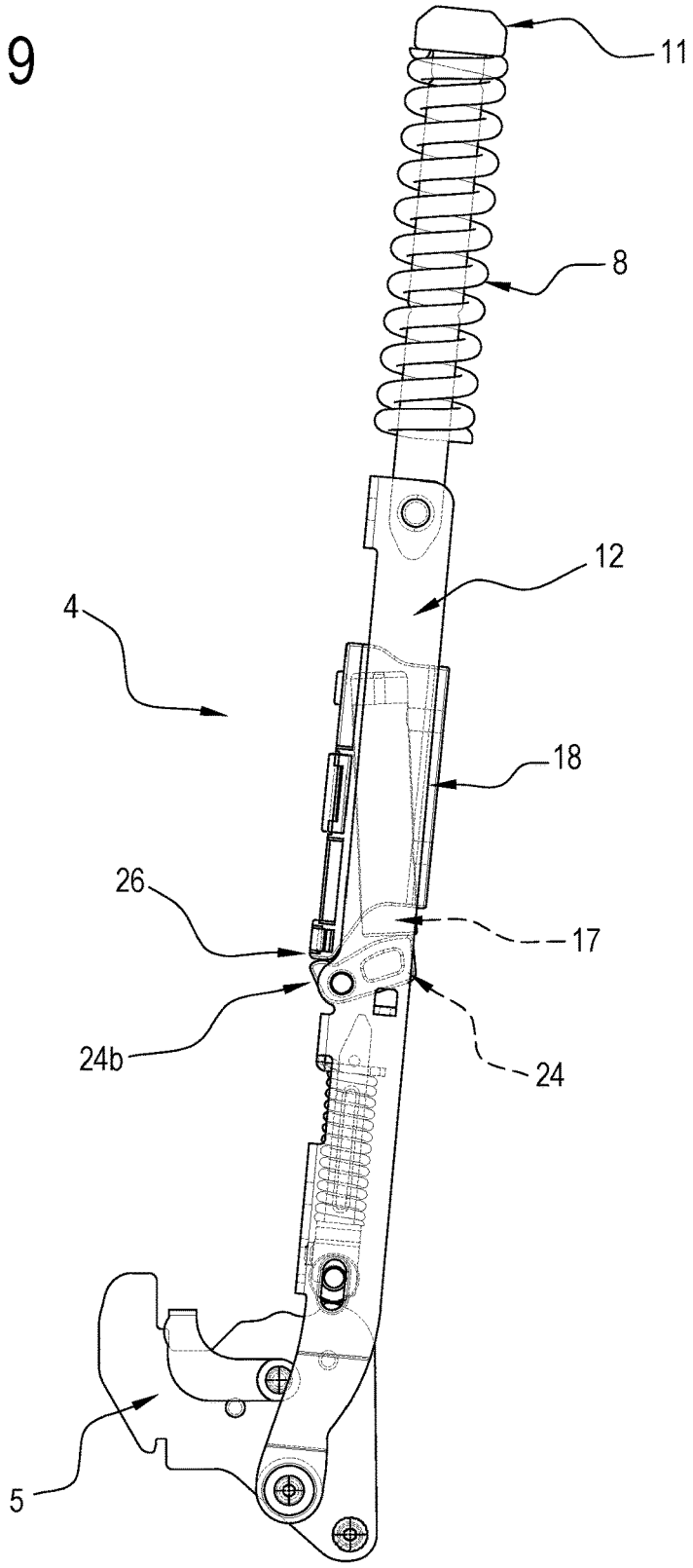
FIG. 9 is a schematic side elevation view, with some parts cut away, of a variant embodiment of the hinge according to the invention, of the detail of FIG. 8.

FIG. 9 shows, relative to a hinge 4 equipped with a cartridge 18 in accordance with the variant embodiment of FIG. 8, a configuration similar to that just described above with reference to FIG. 4.

As the closing of the door 3 continues from the configuration of the hinge 4 illustrated in FIG. 4 to the fully closed configuration illustrated in FIG. 5, the rocker lever 24 performs a rotation in the direction of the arrow R.

As illustrated in FIG. 5, this rotation is caused by the movement of the pin 25, integral with the connecting rod 12 in its sliding relative to the box-shaped element 6 and, at the same time, by the prevention of the translation constituted by the contact portion 26.

In other words, a torque acts on rocker lever 24 determining a moment which is responsible for the rotation of the lever 24.

Following this rotation (anticlockwise with reference to the representation of FIGS. 4 and 5) of the rocker lever 24 about the respective pivot axis Y, the first portion 24*a* of the rocker lever 24 applies a corresponding pushing action on the damping member 17.

This pushing, since the cartridge 18 is fixed in an integral fashion to the box-shaped element 6 with its base 19, determines the compression of the damping member 17 which, consequently, applies its action for damping the reciprocal motion between the first lever 5 and the box-shaped element 6.

The damping action is different to the closing action performed by the springs 8, 14 and makes the movement of the door 3 towards the completely closed position both gradual and slowed down.

It is evident that even in the absence of a braking action by the user, the door 3, pushed by the springs 8, 14 towards the frame 2 of the oven 1, reaches this in a smooth and silent manner thanks to the end of stroke damping performed by the damping member 17.

The hinge according to the invention achieves the preset aims and brings important advantages.

A first advantage is due to the fact that an extremely simple construction of the hinge 4 is obtained by means of the cartridge 18 fixed to the box-shaped element 6 and the actuation of its damping member 17 by the rocker lever 24 supported by the connecting rod 12.

By means of the box-shaped construction of the connecting rod 12 it is also possible to apply the cartridge 18 directly on the box-shaped element 6, proceeding then to the insertion of the connecting rod 12, the latter operation being easily automated.

A further advantage, in terms of simplicity and efficiency is due to the fact that the base 19 of the cartridge also forms a sliding guide of the connecting rod 12.

What is claimed is:

1. A hinge for a door of an electrical household appliance, comprising:

a box-shaped element;

a pivot;

a first lever pivotably supported on the box-shaped element by the pivot; one of either the box-shaped element or the first lever being fixable to a frame of the household electrical appliance and the other of either the box-shaped element or the first lever being fixable to the door, to make the door tiltably movable relative to the frame between a closed position and an open position;

a first elastic device supported by the box-shaped element for applying an elastic action on the first lever, a connecting link connecting the first lever to the first elastic device, the connecting link being slidably positioned inside the box-shaped element;

a hydraulic damper for applying a damping action during reciprocal motion of the first lever and the box-shaped element in a proximity of the closed position;

a cartridge containing the hydraulic damper, the cartridge being fixed to the box-shaped element;

an actuating mechanism for actuating the hydraulic damper, the actuating mechanism including a rocker lever supported by the connecting link and a contact portion fixed to the box-shaped element, the rocker lever including first arm for engaging and actuating the hydraulic damper and a second arm for engaging the contact portion, wherein the reciprocal motion of the first lever and the box-shaped element in the proximity of the closed position causes a relative motion between the contact portion and the hydraulic damper such that the contact portion causes movement of the rocker lever to actuate the hydraulic damper.

2. The hinge according to claim 1, wherein the connecting link is box-shaped and is housed slidably inside the box-shaped element.

3. The hinge according to claim 2, and further comprising a rocker pin, wherein the connecting link has side walls facing each other, wherein the rocker pin is fixed to the connecting link side walls facing each other and the rocker lever is pivotably mounted on the rocker pin.

4. The hinge according to claim 1, and further comprising a second elastic device for applying an elastic action on the first lever, wherein the connecting link supports the second elastic device.

5. The hinge according to claim 3, wherein the cartridge includes respective lateral tabs for centering relative to the box-shaped element.

6. The hinge according to claim 5, wherein the cartridge includes a base, wherein the base includes two elements for snap-on fastening inserted in housings formed on the box-shaped element.

7. The hinge according to claim 6, wherein the contact portion is formed on the box-shaped element.

8. The hinge according to claim 6, wherein the contact portion is formed on the cartridge and fixed to the box-shaped element.

9. The hinge according to claim 1, wherein the first elastic device is a spring.

10. The hinge according to claim 9, wherein the connecting link is box-shaped and is housed slidably inside the box-shaped element.

11. The hinge according to claim 10, wherein the cartridge includes respective lateral tabs for centering relative to the box-shaped element.

12. The hinge according to claim 11, wherein the cartridge includes a base, wherein the base includes two elements for snap-on fastening inserted in housings formed on the box-shaped element.

13. The hinge according to claim 12, wherein the contact portion is formed on the box-shaped element.

14. The hinge according to claim 12, wherein the contact portion is formed on the cartridge and fixed to the box-shaped element.

15. The hinge according to claim 1, wherein the cartridge includes respective lateral tabs for centering relative to the box-shaped element.

16. The hinge according to claim 15, wherein the cartridge includes a base, wherein the base includes two elements for snap-on fastening inserted in housings formed on the box-shaped element.

17. The hinge according to claim 1, wherein the cartridge includes a base, wherein the base includes two elements for snap-on fastening inserted in housings formed on the box-shaped element.

18. The hinge according to claim 1, wherein the contact portion is formed on the box-shaped element.

19. The hinge according to claim 1, wherein the contact portion is formed on the cartridge and fixed to the box-shaped element.

20. The hinge according to claim 1, and further comprising a rocker pin, wherein the connecting link has side walls facing each other, wherein the rocker pin is fixed to the connecting link side walls facing each other and the rocker lever is pivotably mounted on the rocker pin.

* * * * *